US005727351A

United States Patent [19]

Neathery et al.

[11] Patent Number: 5,727,351

[45] Date of Patent: Mar. 17, 1998

[54] MANHOLE INSERT AND TETHER AND METHOD

[76] Inventors: David L. Neathery, 1830 Willow Point, Shreveport, La. 71119; Timothy B. Ely, 660 Eleven O'Clock Rd., Fairfield, Conn. 06430

[21] Appl. No.: 329,064

[22] Filed: Oct. 20, 1994

Related U.S. Application Data

[63] Continuation-in-part of Ser. No. 68,053, May 26, 1993, abandoned.

[51] Int. Cl.[6] ..... E02D 29/14

[52] U.S. Cl. ..... 52/20; 52/19; 70/164; 70/49; 292/237; 404/25; 404/26

[58] Field of Search ..... 52/20, 21, 19; 404/25, 26; 70/18, 30, 49, 164, 166, 168; 292/148, 264, 237

[56] References Cited

U.S. PATENT DOCUMENTS

| | | | |
|---|---|---|---|
| 374,458 | 12/1887 | Davis | 52/20 X |
| 606,554 | 6/1898 | Jacobs | 404/25 |
| 1,384,712 | 7/1921 | Shanley | 52/20 X |
| 1,959,171 | 5/1934 | Mayer | 94/35 |
| 2,576,353 | 11/1951 | Nelson | 182/31 |
| 3,046,853 | 7/1962 | Legendre | 94/34 |
| 3,490,177 | 1/1970 | Perrion | 52/19 X |
| 3,712,009 | 1/1973 | Campagna | 52/20 |
| 3,920,347 | 11/1975 | Sauriol et al. | 404/25 |
| 4,067,659 | 1/1978 | Campagna, Jr. | 404/25 |
| 4,101,154 | 7/1978 | Kagstrom | 292/237 |
| 4,171,851 | 10/1979 | Scraggs | 70/164 X |
| 4,649,674 | 3/1987 | Gaul et al. | 52/20 |
| 4,650,365 | 3/1987 | Runnels | 404/25 |
| 4,915,336 | 4/1990 | Handy | 248/222.1 |
| 4,919,564 | 4/1990 | Neathery | 404/25 |
| 4,957,389 | 9/1990 | Neathery | 404/25 |
| 5,070,712 | 12/1991 | Fox | 70/49 X |
| 5,197,307 | 3/1993 | Abbott, Jr. | 70/164 |
| 5,328,291 | 7/1994 | Wisniewski | 52/20 X |

FOREIGN PATENT DOCUMENTS 41210 4/1908 Switzerland .

*Primary Examiner*—Carl D. Friedman
*Assistant Examiner*—Winnie Yip
*Attorney, Agent, or Firm*—John M. Harrison

[57] ABSTRACT

A watertight manhole insert and tether apparatus designed to prevent rainwater from entering sanitary sewer or other systems through a manhole closed by a manhole cover. The manhole insert is located beneath the manhole cover and is connected directly to the manhole by a tether mounted in the manhole, to plug the manhole and prevent theft of the manhole insert. The manhole insert is characterized by a pan-shaped insert body having a flat insert bottom and a pressure-relief valve, one or more lift straps optionally provided with a warning tag, and an upward-standing, sloping or perpendicular side wall fitted with an outwardly-extending top rim for engaging a shoulder shaped in the manhole to support the manhole insert. One end of the flexible stainless steel tether is connected to the manhole wall and the opposite end first extends through a grommet in the insert bottom and subsequently through a lever bar locking device. According to the method of this inventory when the manhole insert is placed in the manhole, the tether is pulled upwardly through the grommet and the lever bar locking device is slipped along the tether and locked at the insert body to seat the manhole insert on the manhole shoulder. The lever bar locking device operates to crimp the tether and the hasp of a padlock may be extended through registering lock openings provided in the lever bar locking device and locked, to prevent access to the manhole and theft of the manhole insert.

24 Claims, 3 Drawing Sheets

MANHOLE INSERT AND TETHER AND METHOD

CROSS-REFERENCE TO RELATED APPLICATIONS

This application is a continuation-in-part of my U.S. patent application Ser. No. 08/068,053, filed May 26, 1993 now abandoned.

FIELD OF THE INVENTION

This invention relates to manholes for sewer and other systems and more particularly, to a substantially watertight manhole insert and tether which is designed to seal the manhole immediately beneath a manhole cover to prevent flooding of the systems. In a preferred embodiment of the invention the manhole insert is characterized by a stainless steel, cylindrical, pan-shaped insert body having a flat insert bottom provided with a pressure relief valve and connected to a tether for securing the insert body in the manhole. The insert body has upward-standing, sloping or perpendicular sides extending from the insert bottom and terminated by an outwardly-projecting rim adapted for seating on a shoulder formed in the manhole beneath the manhole cover. In a preferred embodiment of the invention the outwardly-extending rim is seated on a seal to minimize the flow of water, sediment and contaminants from ground level around the manhole cover and through the manhole, into the sewer systems. The insert bottom receives one end of the tether through a rubber grommet extending through the insert bottom and the opposite end of the tether is secured in the manhole. Both ends of a lift strap or straps may be attached to the insert bottom opposite or adjacent to the tether, or both, to facilitate lifting and removing the manhole insert from a mounted position in the manhole, throughout the length of the tether. In a preferred embodiment of the invention one end of the tether is attached to a ring bolt mounted in the manhole and the opposite end extends through the grommet in the insert bottom. The tether is threaded through a tether opening provided in one end of an elongated, U-shaped lever bar receptacle and through a registering, transversely-offset tether opening included in one end of a rectangular lever bar extending angularly or perpendicularly from the lever bar receptacle. The lever bar receptacle and lever bar together constitute a locking device for securing the manhole insert in the manhole. After the manhole insert has been placed in the manhole, the tether is pulled upwardly through the rubber grommet provided in the insert bottom and the locking device is slipped along the tether to engage the grommet and securely seat the insert body of the manhole insert against the manhole shoulder. As the lever bar is pivoted to lie entirely in the lever bar receptacle, the tether opening provided in the lever bar is shifted in a camming increment to misalign with the tether openings provided in the lever bar receptacle, thus crimping the tether and preventing the tether from slipping through the grommet. The hasp of a padlock is then extended through registering lock openings provided in the lever bar receptacle and lever bar and the padlock locked, to prevent access to the manhole and theft of the manhole insert. The pressure relief valve installed in the insert bottom is designed to relieve pressure which may be generated in the sewerage system served by the manhole and also operates to relieve any vacuum which may develop in the sewer system.

One of the problems which is associated with sewer systems is that of flooding during periods of high water due to prolonged or heavy rainfall. This problem is intensified in both urban and surburban areas where increased construction activity has resulted in large quantities of concrete being poured to construct parking lots, as well as foundations and other structures. This proliferation of non-permeable construction material reduces the amount of surface area which is available to absorb rainfall and increases the flow of water in storm drains and sewer systems, as well as diversion canals, natural streams and other channels which must accept and dispose of the increased flow of water. These conditions of urban and suburban development result in flooding under circumstances where the water run-off exceeds the capacity of the storm drain and sewer systems, which are sized to receive a specified average flow of water. Moreover, although it is customary to provide separate drainage systems for rainwater and sewage, flooding of the sewerage systems by rainwater runoff sometimes creates a contamination problem.

Another problem relating to sewer and other systems is the unauthorized entry of these subterranean tunnels by children and adults for various purposes. Sewer lines and tunnels may contain toxic and/or flammable gases, low oxygen, liquid contaminants and like hazards. Furthermore, sudden rainstorms can quickly flood sewerage systems and due to the extensive network of pipes, channels and tunnels in such a system, people can easily become lost in the underground labyrinth.

DESCRIPTION OF THE PRIOR ART

Various types of closures and covers, many of which are fitted with ventilating means, have been long known in the art. An early German patent No. 41,210 details a manhole having a removable cover connected to the manhole by a chain. Another early patent which details such a closure is the "Ventilating Vault Cover", detailed in U.S. Pat. No. 606,554, dated Jun. 28, 1898, to J. Jacobs. The ventilating vault cover is designed to close a vault opening in a watertight manner when in a closed position and vent the vault when in open configuration. U.S. Pat. No. 1,959,171, dated May 15, 1934, to N. C. Mayer shows a manhole construction which includes an adapter for raising a manhole cover after road construction. U.S. Pat. No. 3,046,853, dated Jul. 31, 1962, to C. Legendre, discloses a "Manhole Closure". The manhole closure includes a lid of one-piece construction which cooperates with a seat or manhole frame, also of one-piece construction, such that the two parts can be easily assembled for mounting in a manhole. A "Safety Replacement Cover for Catch Basins" is detailed in U.S. Pat. No. 2,576,353, dated Nov. 27, 1951, to O. W. Nelson. The cover detailed in this patent includes a dish-like, reticulate tray which is designed to provide adequate drainage into a catch basin and facilitates safety to prevent injury from stepping into the catch basin. A "Manhole Cover" is covered in U.S. Pat. No. 3,920,347, dated Nov. 18, 1975, to John T. Sauriol, et al. The manhole cover is constructed of a molded synthetic polymeric material and has a transversely intersecting structural rib network which is integrally joined with a top surface portion and encloses annular peripheral portions of the cover. The structural rib network is preferably dome-shaped, with the principal structural support disposed centrally of the cover at the apex of the dome. A "Drain Hole Seal With Bottom Bleeder" is detailed in U.S. Pat. No. 4,649,674, dated Mar. 17, 1987, to Craig S. Gaul, et al. The patent details a seal structure having a bottom bleeding feature such as a bottom bore and fitted with a flange to facilitate sealing engagement between a cover and a frame located around an access opening of the manhole. The structure includes a central portion which is downwardly depressed to avoid a path of spin of the cover. A "Watertight Manhole Insert" is set forth in U.S. Pat. No. 4,650,365, dated Mar. 17, 1987, to Franklin D. Runnels. The manhole insert is designed to prevent rainwater from entering a sanitary sewer system through manholes which are closed by manhole covers. The insert includes a shallow, dish-shaped body portion and a mounting flange designed to rest upon the supporting flange of a manhole frame. A recess is formed in the bottom of the body portion and includes a valve for releasing any pressure which may accumulate in the manhole beneath the insert. The valve is shielded to prevent damage by a manhole cover sliding across the insert. Additionally, the valve can be used as a handle to remove the insert from the manhole. The Runnels insert has also been modified in application to include a circumferential rib near the rim for stiffening purposes. A "Manhole Closure Assembly", detailed in U.S. Pat. No. 4,067,659, dated Jan. 10, 1978, and a "Manhole Closure Assembly with Valve Relief Means" covered by U.S. Pat. No. 3,712,089, dated Jan. 23, 1973, are both issued to Samuel A. Campagna, Jr., et al. Both assemblies are designed to prevent accumulated storm water from entering a manhole opening and includes a cover section having a downwardly-depressed central portion. A circular mounting flange extends outwardly from the depressed central portion and the flange is adapted to rest upon inwardly-directed manhole cover supporting flanges of the annular manhole frame. The cover section is depressed, such that the cover exceeds the path of spin when resting upon the supporting flange of the manhole frame. A valve is secured to the cover section for the purpose of relieving pressure inside the manhole when the sewer pressure exceeds a predetermined level. My U.S. Pat. No. 4,919,564, issued Apr. 24, 1990, details a "Manhole Insert" characterized by a dish-shaped seal or stopper positioned below a manhole cover to plug the manhole and prevent flooding of the underlying sewer system. My U.S. Pat. No. 4,957,389 covers a "Method And Apparatus for Sealing Manholes", using a donut-shaped seal structure in the chimney.

It is an object of this invention to provide a new and improved manhole insert and tether which is designed to close and substantially seal a manhole and prevent rainwater from flooding a sewer or other system communicating with the manhole, as well as secure the manhole insert in the manhole or within the length of the tether, to prevent unauthorized entry into the manhole and/or theft of the manhole insert.

Another object of the invention is to provide a manhole insert and tether apparatus, which manhole insert is molded, stamped or otherwise shaped from a selected metal or synthetic polymeric material into a pan-shaped, flat-bottomed, flanged insert body for installation on a shoulder provided in a manhole beneath the manhole cover in order to prevent, or at least reduce, the flow of rainwater into the manhole and the underlying disposal system and prevent, or at least minimize, theft of the manhole insert and/or entry of the manhole, by operation of the tether.

A still further object of this invention is to provide a stainless steel manhole insert characterized by a pan-shaped insert body having a flat insert bottom which slidably receives one end of a flexible, braided or stranded stainless steel tether, the opposite end of which tether is connected to the manhole. A continuous side wall extends from the manhole insert bottom, with a flange or rim outwardly-extending from the side wall, which rim engages the shoulder of the manhole located beneath the manhole cover to retard water from flowing into the manhole and the underlying sewer or drainage system as the tether drastically reduces the incidence of theft of the manhole insert.

Yet another object of the invention is to provide a manhole insert and slidably connecting tether and crimp or cam lock for retarding the flow of water into a sewer or other system through a manhole and substantially preventing access into the manhole and theft of the manhole insert, which manhole insert is characterized by a flat-bottomed closure or insert body having an outwardly-projecting flange or rim fitted with a rubber seal and further including one or more lift straps or handles attached to the dish-shaped closure or insert body and a warning tag attached to at least one of the left straps or handles, which manhole insert is located in the manhole beneath the manhole cover.

Still another object of this invention is to provide a new and improved manhole insert which includes a pan-shaped, flat-bottomed stainless steel stopper, plug or insert body having a pressure relief valve mounted therein and further including an outwardly-extending rim fitted with a rubber seal and a flexible, braided or stranded stainless steel wire tether having one end extending through a grommet in the flat insert bottom of the insert body and fitted with a lever-operated, cam-type locking device, with the opposite end of the tether attached to the manhole, along with one or two lift straps for removing the insert body from a manhole located beneath the manhole cover and a warning tag attached to at least one of the lift straps.

Another object of the invention is to provide a new and improved manhole insert characterized by a stainless steel, flat-bottomed insert body which is fitted with a flared or perpendicular side and a flange or rim for mounting in the upper portion of a manhole beneath the manhole cover, a flexible, stainless steel tether having one end attached to a fixed ring bolt mounted in the manhole and the opposite end projecting through a grommet mounted in the insert bottom element of the insert body and then through a tether opening provided in one end of an elongated U-shaped lever bar receptacle and through a registering, transversely-offset opening included in a rectangular lever bar accommodated in and extending angularly or perpendicularly from the lever bar receptacle, which lever bar is pivoted in a camming action to rest entirely in the lever bar receptacle, crimp the tether and thus prevent the tether from slipping through the grommet. A padlock may then be secured to the lever bar and lever bar receptacle to secure the manhole insert in the manhole, in order to reduce or prevent the flow of water into an underlying sewer system, control manhole odor, prevent the accumulation of dirt and trash in the manhole and the underlying sewer and substantially prevent theft of the manhole insert and access to the manhole.

A still further object of this invention is to provide a method of locking a manhole insert in a manhole beneath a manhole cover, which includes the steps of providing a manhole insert having a pan-shaped insert body for seating in the manhole; providing an opening in the insert body; extending a flexible tether through the opening and securing one end of the flexible tether to the manhole; and sliding a tether lock on the opposite end of the flexible tether, such that the manhole insert is secured in the manhole opening responsive to pulling the flexible tether through the opening to tighten the flexible tether between the insert body and the manhole, sliding the tether lock on the flexible tether to the insert body and locking the tether lock on the flexible tether. The tether lock may be further secured in place by a lock such as a padlock.

SUMMARY OF THE INVENTION

These and other objects of the invention are provided in a manhole insert and method for sealing and preventing unauthorized access into sewerage systems, which manhole insert is characterized by a molded, stamped, pressed or otherwise formed, flat-bottomed stainless steel insert body provided with a pressure and/or vacuum relief valve and an upward-standing, sloping or perpendicular side wall, terminated by an outwardly-projecting rim for seating on a ledge provided in a manhole beneath the manhole cover, in order to prevent rainwater from flowing around the edge of the manhole cover into the manhole and through the underlying sewer system. A flexible, stranded, stainless steel rope tether has one end connected to a ring bolt mounted in the manhole cone or wall and the opposite end of the tether extends through a rubber grommet mounted in the insert bottom and then through a locking device preferably characterized by a U-shaped lever bar receptacle and a lever bar extending from the lever bar receptacle and slidably mounted along with the lever bar on the tether, which lever bar is pivoted to rest entirely in the lever bar receptacle to crimp the tether by cam action and may be locked with a padlock to prevent the tether from slipping through the tether and securely seat the lever bar receptacle against the insert body and the manhole insert. in the manhole.

BRIEF DESCRIPTION OF THE DRAWING

The invention will be better understood by reference to the accompanying drawings, wherein.

DESCRIPTION OF THE PREFERRED EMBODIMENTS

Figure 1:
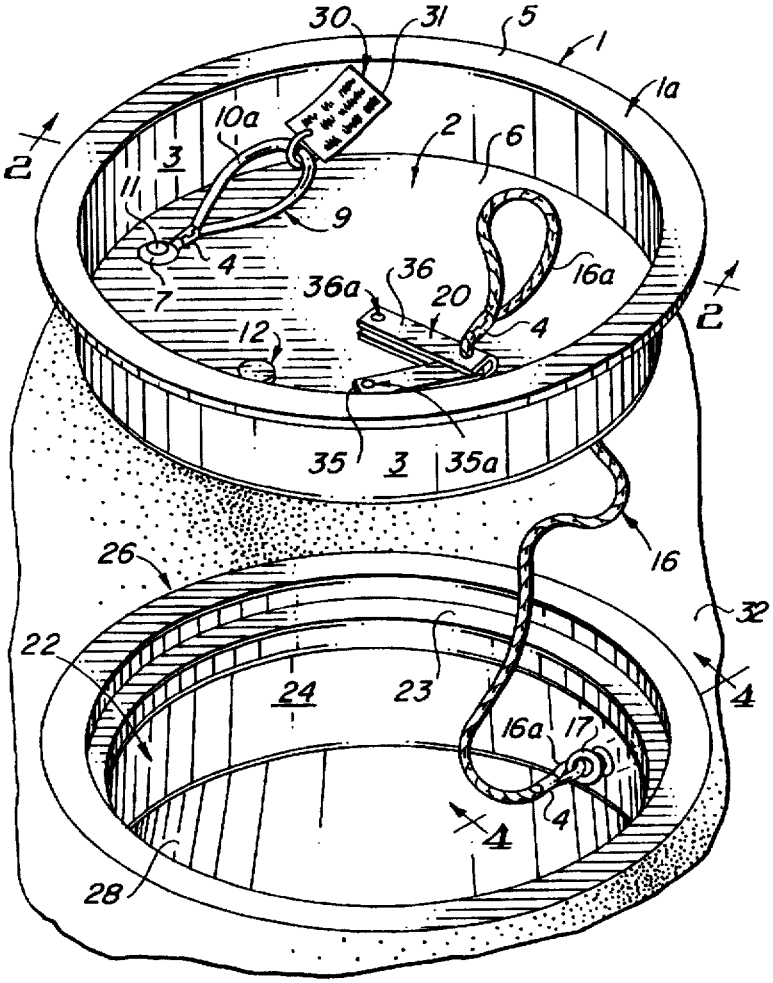
FIG. 1 is a perspective view of the manhole insert and tether of this invention, with the manhole insert spaced from in a manhole and connected to the manhole by the tether.
Figure 10:
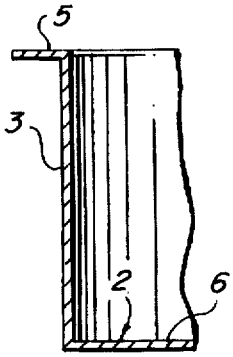
FIG. 10 is a sectional view of the insert body element of the manhole insert and tether of this invention, illustrating the side wall element disposed perpendicular with respect to the insert bottom element.
Figure 11:
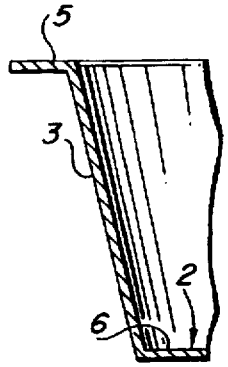
FIG. 11 is a sectional view of the insert body element of an alternative embodiment of the manhole .insert and tether of this invention, illustrating the side wall element disposed at an obtuse angle with respect to the insert bottom element.
Figure 1A:
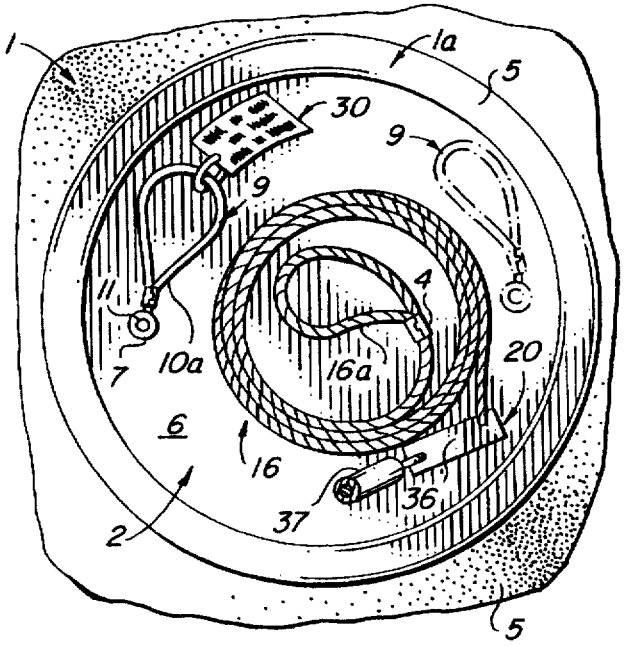
FIG. 1A is a top view of the manhole insert and tether of this invention, with the manhole insert inserted in the manhole and the locking device element locked on the tether to secure the manhole insert in the manhole.
Figure 5:
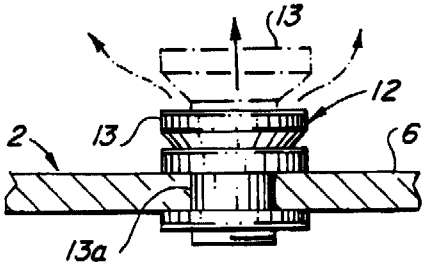
FIG. 5 is an enlarged view, partially in section, of a pressure relief valve mounted in the insert bottom element of the manhole insert.
Figure 4:
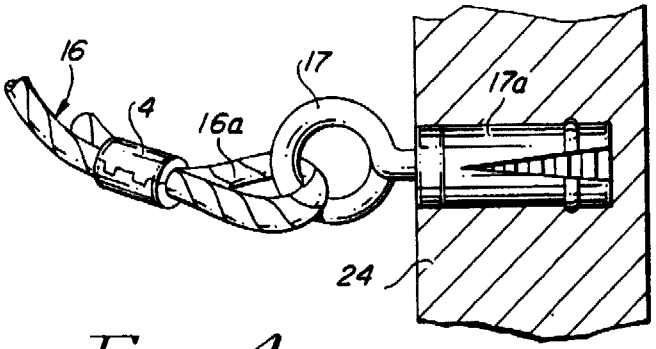
FIG. 4 is an enlarged sectional view taken along section line 4—4 in FIG. 1, of a typical ring bolt and bolt anchor for securing the tether in the manhole cone or wall.

Referring initially to FIGS. 1–7, 10 and 11 of the drawings, the manhole insert and tether of this invention is generally illustrated by reference numeral 1. The manhole insert element is characterized by a dish or pan-shaped insert body 1*a*, including a flat insert bottom 2, having a smooth, bottom surface 6, which terminates in a circular, upward-standing side wall 3. The side wall 3 may be substantially perpendicular with respect to the insert bottom 2, as illustrated in FIG. 10, or disposed at an obtuse angle and sloped with respect to the insert bottom 2, as illustrated in FIG. 11. A rim 5 projects substantially horizontally outwardly from the top edge of the side wall 3 and seats on a manhole shoulder 23, provided in the manhole structure 26 beneath the street level 32, as hereinafter described. In a most preferred embodiment the manhole insert 1*a* is shaped from stainless steel or molded from a suitable moldable plastic material, as hereinafter described. Alternatively, the manhole insert 1*a* can be stamped, pressed, cast or otherwise formed from other suitable metals such as aluminum, in non-exclusive particular. As illustrated in FIGS. 1 and 5, a pressure relief valve 12 includes a valve seat 13, mounted in a valve body 13*a* extending through the insert bottom 2. The valve seat 13 is lifted from the valve body 13*a* to release pressure which may build up in the manhole 22.

Figure 3:
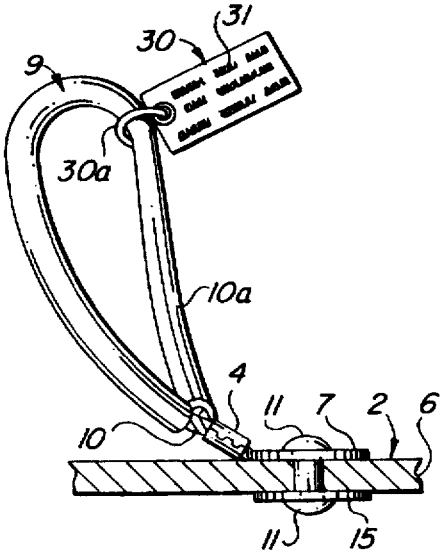
FIG. 3 is an enlarged sectional view, taken at circle 3 in FIG. 2, of a preferred lift strap mounted on the insert bottom element of the manhole insert.
Figure 2:
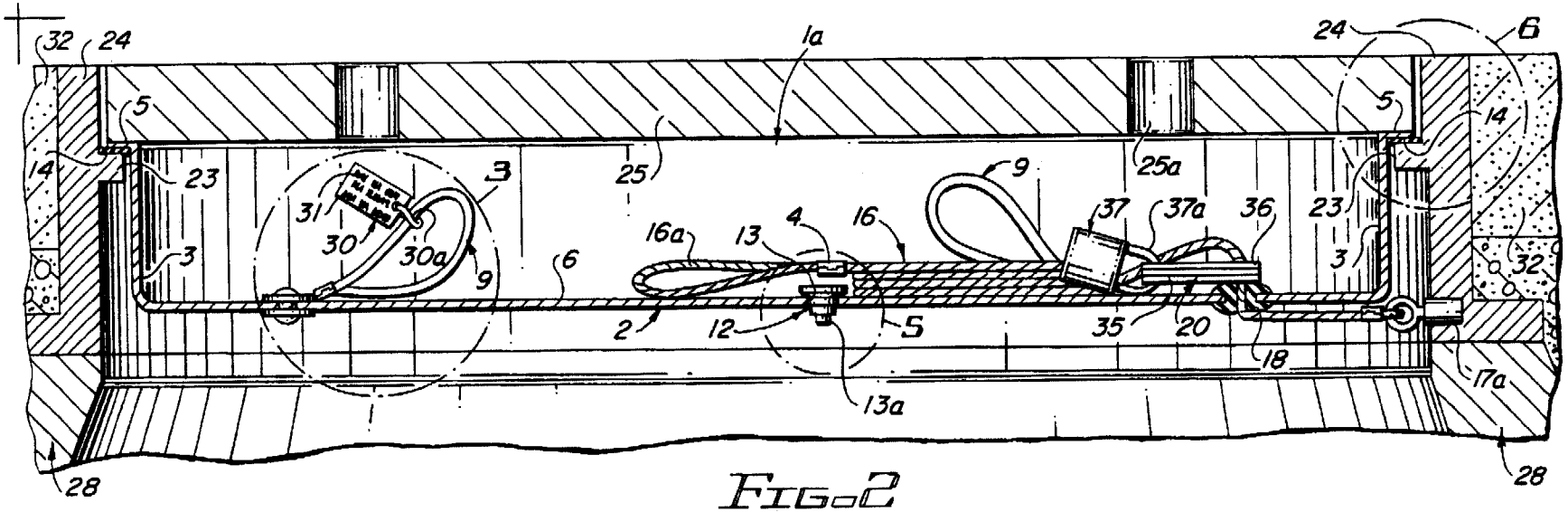
FIG. 2 is a sectional view taken along section line 2—2 of the manhole insert and tether illustrated in FIG. 1, with the manhole insert mounted in the manhole and the locking device element locked on the tether.
Figure 6:
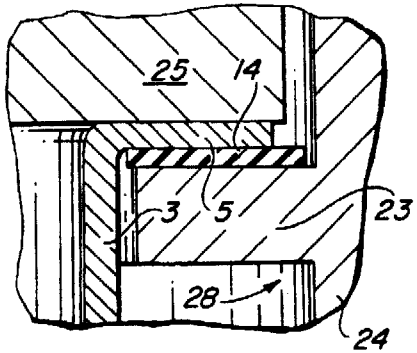
FIG. 6 is an enlarged sectional view, taken at circle 6 in FIG. 2, of a preferred seal or gasket for sealing the rim element of the manhole insert between the manhole shoulder and the manhole cover.

In a preferred embodiment of the invention the manhole insert 1 is mounted in the manhole 22 with the rim 5 of the manhole insert 1*a* engaging the manhole shoulder 23 located in the manhole structure 26, as illustrated in FIG. 2. In a most preferred embodiment of the invention a nitrile, neoprene or alternative gasket or seal 14 is fitted under the rim 5, lying adjacent to and resting on the manhole shoulder 23 of the manhole structure 26, as further illustrated in FIG. 6. As illustrated in FIGS. 1 and 3, the ends of a strap cable 10 of a lift strap 9 are fitted with a cable stay 4 and welded to a companion lift strap mount washer 7, secured to the insert bottom 2 by means of a stainless steel rivet 11 and a companion mount washer 15. One end of a length of flexible stainless steel tether 16 is shaped in a tether loop 16*a* by means of a stainless steel cable stay 4, after looping through a grommet 18, seated in a bottom opening 8 (illustrated in FIGS. 8B and 8D) provided in the insert bottom 2 of the manhole insert 1*a*. The opposite end of the tether 16 is threaded through a stainless steel ring bolt 17 seated in a lead bolt anchor 17*a*, which is mounted in a hole drilled in the manhole wall 24 of the manhole structure 26, as detailed in FIG. 4. Alternatively, the tether 16 may be secured to any desired chemical-resistant mounting. anchor which can be anchored to the manhole wall 24, according to the knowledge of those skilled in the art.

Figure 8A:
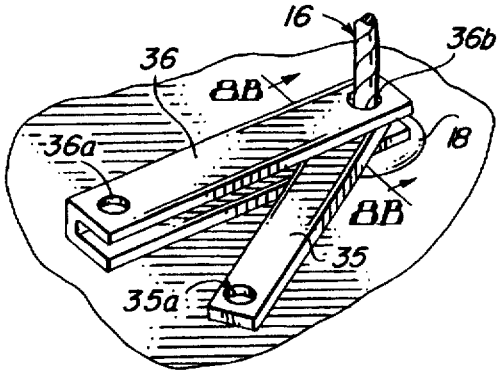
FIG. 8A is a perspective view of a lever bar and lever bar receptacle locking mechanism for the tether, illustrated in unlocked, tether-release configuration.

Referring now to FIGS. 1, 2 and 8A–9B of the drawings, a locking device 20 slidably engages that portion of the tether 16 extending above the bottom surface 6 of the insert bottom 2 for securely seating and locking the manhole insert 1 in the manhole 22, as hereinafter described. As illustrated in FIG. 8A, the locking device 20 includes an elongated lever bar receptacle 36 having a generally U-shaped cross-sectional configuration. A pair of aligned receptacle lock openings **36*a* are provided in opposite sides of the lever bar receptacle 36, adjacent to one end thereof, as illustrated in FIGS. 1, 8A and 8C and a pair of aligned receptacle tether openings 36*b* are also provided in opposite sides of the lever bar receptacle 36, adjacent to the other end thereof, as illustrated in FIGS. 8A and 8C. A generally rectangular lever bar 35, having a transversely offset lever bar tether opening 35*b* (illustrated in phantom in FIG. 9B) adjacent to one end thereof and a lever bar lock opening 35*a*, adjacent to the other end thereof, is accommodated in the lever bar receptacle 36, with the lever bar tether opening 35*b* positioned substantially in registry with the receptacle tether openings 36*b* when the lever bar 35 is extending from the lever bar receptacle 36, as illustrated in FIG. 9A. As illustrated in FIG. 8B, the tether 16, after extending through the grommet 18, first extends through one of the receptacle tether openings 36*b*, then through the lever bar tether opening 35*b* and finally through the other receptacle tether opening 36*b* and typically terminates in a tether loop 16*a*, fitted by a cable stay 4, as illustrated in FIGS. 1 and 2**.

Figure 8C:
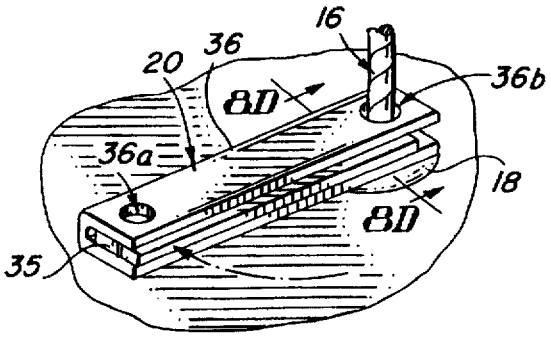
FIG. 8C is a perspective view of the lever bar and lever bar receptacle locking mechanism for the tether, illustrated in locked, tether-crimping configuration.
Figure 8B:
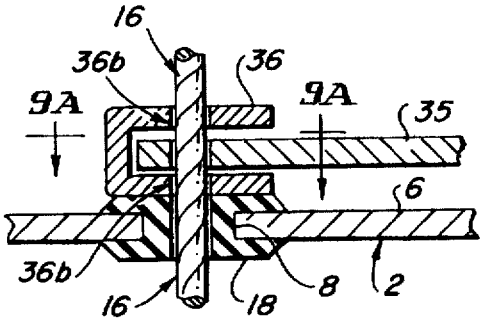
FIG. 8B is an enlarged sectional view taken along section line 8B—8B in FIG. 8A of the lever bar and lever bar receptacle locking mechanism, illustrated in FIG. 8A.
Figure 8D:
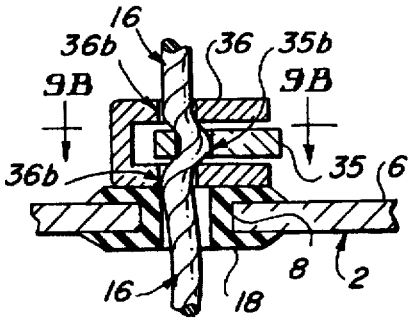
FIG. 8D is an enlarged sectional view taken along section line 8D—8D in FIG. 8C of the lever bar and lever bar receptacle locking mechanism illustrated in FIG. 8C.
Figure 8E:
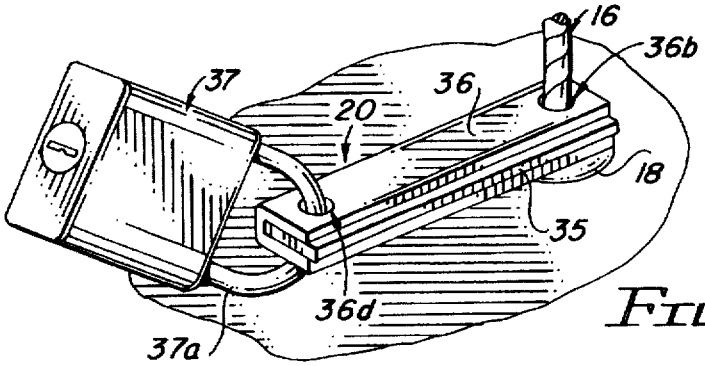
FIG. 8E is a perspective view of the lever bar and lever bar receptacle locking mechanism, illustrated in locked, tether-crimping configuration and secured by a padlock.
Figure 9A:
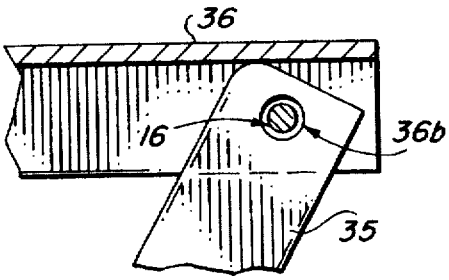
FIG. 9A is a top view, partially in section, of the tether extending through the lever bar and lever bar receptacle elements in uncrimped configuration.
Figure 9B:
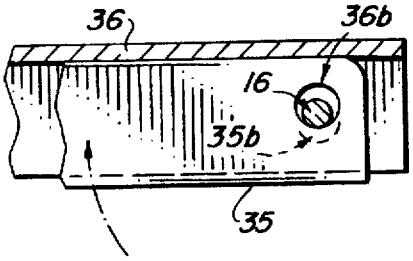
FIG. 9B is a top view, partially in section, of the tether extending through the lever bar and lever bar receptacle elements in crimped configuration.

In operation, the manhole insert 1 is mounted in functional position in the manhole structure 26 by seating the rim 5 of the insert body **1*a* on the manhole shoulder 23, located in the manhole 22 below the street level 32, as illustrated in FIGS. 1 and 2. The tether 16 is pulled upwardly through the grommet 18 and the locking device 20 is slipped downwardly on the tether 16 to engage that portion of the grommet 18 located on the bottom surface 6 of the manhole insert 1*a*, as illustrated in FIGS. 2, 8A and 8C. As the lever bar 35 is pivoted from the outwardly-extending configuration illustrated in FIGS. 8A and 9A to lie entirely within the lever bar receptacle 36, as illustrated in FIGS. 8C and 9B, the lever bar tether opening 35*b* is shifted from registering relationship with respect to the receptacle tether openings 36*b*, as illustrated in FIG. 8B, to an offset relationship, causing crimping of the tether 16, as illustrated in FIG. 8D. The hasp 37*a* of a padlock 37 is then extended through one of the receptacle lock openings 36*a* (provided in one side of the lever bar receptacle 36), through the now registering lever bar lock opening 35*a* and finally through the receptacle lock opening 36*a* provided in the other side of the lever bar receptacle 36 and locked, to secure the lever bar 35 and lever bar receptacle 36 in tether-crimping configuration and prevent the tether 16 from slipping through the grommet 18. It will be appreciated that the locking device 20 can be unlocked and the manhole insert 1 lifted from the functional position in the manhole 22 to the full length of the tether 16, as illustrated in FIG. 1, when the conventional manhole cover 25 is moved from the manhole 22. This expedient prevents theft of the manhole insert 1, yet allows removal of the manhole insert 1 from the manhole 22 for repair work in the manhole 22. A warning tag 30 may be attached to the lift strap 9 by means of a tag strap 30*a*. Tag indicia 31 printed on the warning tag 30** may include such warnings as: "DANGER- PERMIT- REQUIRED CONFINED SPACE, DO NOT ENTER" or similar language.

It will be appreciated that while the manhole insert **1*a* can be configured from molded synthetic polymeric materials such as polyethylene, polypropylene and acrylonitrile-butadiene-styrene (commonly called ABS) as well as metals such as aluminum and steel, in non-exclusive particular, stainless steel is a preferred material of construction. Furthermore, in a most preferred embodiment of the invention, the pressure relief valve 12** is designed to relieve manhole pressure in a pressure range of from about 0.5 psi to about 1.6 psi.

Figure 7:
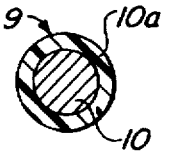
FIG. 7 is a cross-sectional view of the tether illustrated in FIG. 1, more particularly illustrating a preferred construction of the tether.

In another preferred embodiment of the invention and referring again to FIGS. 1A–3 of the drawings, a second lift strap 9, with or without a warning tag 30, is secured to the insert bottom 2 near the grommet 18 by means of a stainless steel rivet 11, a lift strap mount washer 7 and a mount washer 15, in the same manner as the lift strap 9 illustrated in FIG. 3. Since it is common practice for workmen to engage a lift strap 9 with a pick or other tool in order to remove the manhole insert 1 from the manhole 22, it has been found that the lift strap or straps 9 must be well secured to the insert bottom 2 to insure that the lift strap 9 does not tear away from the insert bottom 2. It has been found that when the lift strap(s) 9 is attached to the insert bottom 2 by the stainless steel rivet 11 in this manner, a force in excess of 500 pounds is necessary to tear the lift strap 9 away from the insert bottom 2. In another preferred embodiment the lift strap(s)9, as well as the tether 16, include a plastic cable sheath **10*a*, as illustrated in FIG. 7, to which the tag strap 30*a* is secured for attachment of the warning tag 30**.

It will be appreciated by those skilled in the art that the manhole insert and tether of this invention is characterized by convenience and flexibility and operates to stop the flow of water, sediment and contaminants into sewer systems, control manhole odors, prevent dirt and trash from accumulating in the manhole and the sewer system and helps to prevent manhole rattling and "flipping" due to street traffic. The tether 16 allows removal of the manhole insert 1 from the manhole 22 to provide access to the manhole 22, while preventing theft or other removal of the manhole insert 1 from the area of the manhole 22, as illustrated in FIG. 1. The tether 16 also serves to secure the manhole insert 1 in functional position in the manhole 22, as illustrated in FIGS. 2 and 8A–9B, by initially unlocking the padlock 37 (or alternative locking device), pivoting the lever bar 35 from the lever bar receptacle 36 and allowing the tether 16 to slide inside the receptacle tether openings **36*b* and lever bar tether opening 35*b*. This facilitates sliding the tether 16 through the locking device. 20 to tighten that segment of the tether 16 located between the insert bottom 2 and the ring bolt 17. The lever bar 35 is then pivoted into the lever bar receptacle 36 to again crimp the tether 16 and secure the locking device 20 on the tether 16. The manhole insert 1 is thusly secured in the manhole 22, as heretofore described. The manhole insert 1 is then configured to be maintained in position on the manholes shoulder 23 in a manhole 22 without dropping from that position into the manhole 22 or sewer underlying the manhole 22 and without the hazard of theft or unauthorized entry into the manhole 22, due to application of the tether 16. The rubber grommet 18 allows slippage of the tether 16 when the locking device 20 is in the unlocked, uncrimping configuration, but also facilitates seating of the tether 16–grommet 18 interface to prevent leakage of water from the manhole insert 1 into the manhole 22**.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A manhole insert and tether comprising a pan-shaped insert body for seating in the wall of a manhole and having a tether opening, a tether having one end slidably extending through said tether opening and the opposite end adapted for mounting in the wall of the manhole, and tether lock means slidably carried by said one end of said tether for selectively tightly engaging said tether at said insert body and locking said insert body in the manhole.

2. The manhole insert and tether of claim 1 further comprising a pressure relief valve provided in said insert body for relieving pressure in the manhole.

3. The manhole insert and tether of claim 1 wherein said insert body comprises a flat insert bottom, a continuous side wall upward-standing from said insert bottom and a rim shaped in said side wall for supporting said insert body in the manhole.

4. The manhole insert and tether of claim 1 further comprising at least one lift strap attached to said insert body for lifting said insert body from the manhole when said tether lock means is unlocked and slidably displaced on said tether.

5. The manhole insert and tether of claim 4 wherein said insert body comprises a flat insert bottom, a continuous side wall upward-standing from said insert bottom and a rim shaped in said side wall for supporting said insert body in the manhole and both ends of said lift strap are attached to said insert bottom.

6. The manhole insert and tether of claim 5 further comprising a pressure relief valve provided in said insert bottom for relieving pressure in the manhole and a warning tag attached to said lift strap.

7. The manhole insert and tether of claim 6 wherein said insert body is formed of stainless steel and further comprising a padlock releasably engaging said tether lock means for selectively locking said tether lock means on said tether.

8. The manhole insert and tether of claim 7 wherein said lift strap comprises a loop of stainless steel cable and further comprising a rivet connecting both ends of said stainless steel cable to said insert bottom.

9. The manhole insert and tether of claim 5 further comprising gasket means for engaging the manhole wall and said rim for sealing said insert body in the manhole.

10. The manhole insert and tether of claim 1 further comprising a pair of lift straps attached to said insert body for lifting said insert body from the manhole when the manhole cover is removed and wherein said tether lock means comprises a locking device crimping said tether.

11. The manhole insert and tether of claim 1 wherein said insert body comprises a flat insert bottom, a continuous side wall upward-standing from said insert bottom and a rim shaped in said side wall for supporting said insert body in the manhole and comprising at least one braided cable lift strap attached to said insert bottom for lifting said insert body from the manhole when the manhole cover is removed, and wherein said lock means comprises a locking device crimping said tether.

12. The manhole insert and tether of claim 11 further comprising a pressure relief valve provided in said insert bottom for relieving pressure in the manhole and a warning tag attached to said braided cable lift strap.

13. The manhole insert and tether of claim 11 wherein said at least one braided cable lift strap comprises a pair of braided stainless steel lift straps.

14. The manhole insert and tether of claim 12 further comprising gasket means for engaging the manhole wall and said rim for sealing said insert body in the manhole.

15. The manhole insert and tether of claim 1 wherein said insert body comprises a flat insert bottom, a continuous side wall upward-standing from said insert bottom in sloping relationship with respect to said insert bottom and a rim shaped in said side wall for supporting said insert body in the manhole.

16. The manhole insert and tether of claim 15 further comprising a pressure relief valve provided in said insert bottom for relieving pressure in the manhole.

17. The manhole insert and tether of claim 16 further comprising a loop of stainless steel cable and a rivet connecting said stainless steel cable to said insert bottom.

18. The manhole insert of claim 17 further comprising gasket means for engaging the manhole wall and said rim and sealing said insert body in the manhole and a padlock releasably engaging said tether lock means for selectively locking said tether lock means on said tether.

19. A manhole insert and tether comprising a pan-shaped insert body including a flat insert bottom having a tether opening and terminated by an upward-standing, continuous side wall for seating in a manhole; a pressure release valve extending through said insert bottom for releasing pressure in the manhole; a rim shaped in the top edge of said side wall for engaging the shoulder of the manhole and supporting said insert body on the shoulder; a flexible tether of selected length having one end extending through said tether opening and the opposite end of said tether adapted for fixed attachment to the wall of the manhole; and a tether locking device slidably engaging said one end of said tether for selectively locking on said tether and securing said insert body in the manhole.

20. The manhole insert and tether of claim 19 further comprising gasket means for engaging the manhole wall and said rim and sealing said insert body in the manhole and a padlock releasably engaging said tether locking device for selectively locking said tether locking device on said tether.

21. The manhole insert and tether of claim 20 further comprising at least one tether loop shaped in said one end of said flexible tether for extending a portion of said tether through said tether opening when the manhole cover is removed and securing said tether locking device on said tether at said insert bottom and securing said padlock on said tether locking device.

22. The manhole insert of claim 19 wherein said locking device comprises an elongated, generally U-shaped lever bar receptacle including a first side having a first receptacle tether opening and a first receptacle lock opening spaced from said first receptacle tether opening; a second side continuous with said first side and having a second receptacle tether opening aligned with said first receptacle tether opening and a second receptacle lock opening aligned with said first receptacle lock opening; a generally rectangular lever bar extending from said lever bar receptacle and having a transversely-offset lever bar tether opening registering with said first receptacle tether opening and said second receptacle tether opening and a lever bar lock opening spaced from said lever bar tether opening, whereby said tether passes through said first receptacle tether opening, said lever bar tether opening and said second receptacle tether opening, respectively, and said lever bar is pivoted from a first position extending from said lever bar receptacle to a second position within said lever bar receptacle to crimp said tether responsive to manipulation of said lever bar inside said lever bar receptacle and further comprising a security lock having a hasp extended through said first receptacle lock opening, said lever bar lock opening and said second receptacle lock opening, respectively, said hasp then locked in said security lock to prevent said lever bar from pivoting from said lever bar receptacle and said tether from slipping through said tether opening.

23. A method of locking a manhole insert in a manhole beneath a manhole cover and preventing unauthorized entry into the manhole, comprising the steps of providing a manhole insert having a pan-shaped insert body for seating in the manhole; providing an opening in said insert body; extending a flexible tether through said opening and Securing one end of said flexible tether to the manhole; seating the insert body in the manhole; and sliding a tether lock on said opposite end of said flexible tether, whereby said manhole insert is secured in the manhole responsive to pulling said opposite end of said flexible tether through said opening to tighten said flexible tether between said insert body and the manhole, sliding said tether lock on said opposite end of said flexible tether to said insert body and locking said tether lock on said flexible tether.

24. The method according to claim 23 comprising the step of attaching a padlock to said tether lock for further securing said tether lock on said flexible tether.

* * * * *